US008001710B2

(12) United States Patent
McKye

(10) Patent No.: US 8,001,710 B2
(45) Date of Patent: Aug. 23, 2011

(54) BIODEGRADABLE BADGE

(75) Inventor: Scott McKye, Sunset Hills, MO (US)

(73) Assignee: Technical Sales & Services, Inc., Fenton, MO (US)

( * ) Notice: Subject to any disclaimer, the term of this patent is extended or adjusted under 35 U.S.C. 154(b) by 43 days.

(21) Appl. No.: 12/315,448

(22) Filed: Dec. 3, 2008

(65) Prior Publication Data

US 2009/0145008 A1 Jun. 11, 2009

Related U.S. Application Data

(60) Provisional application No. 61/005,292, filed on Dec. 4, 2007.

(51) Int. Cl.
*A44C 3/00* (2006.01)

(52) U.S. Cl. ..... 40/1.5; 40/661; 24/3.4

(58) Field of Classification Search ..... 40/647, 40/586, 1.6, 1.5; 24/543, 3.4, 3.1, 129 R, 24/115 F; 403/361, 282
See application file for complete search history.

(56) References Cited

U.S. PATENT DOCUMENTS

| | | | | |
|---|---|---|---|---|
| 1,363,709 | A * | 12/1920 | Bernier | 24/3.1 |
| 2,548,104 | A * | 4/1951 | Frison | 40/586 |
| 2,826,000 | A * | 3/1958 | Fischman et al. | 446/99 |
| 3,553,865 | A * | 1/1971 | Jones | 40/643 |
| 3,914,061 | A * | 10/1975 | Meyer | 403/197 |
| 5,027,477 | A * | 7/1991 | Seron | 24/3.4 |
| 5,115,000 | A | 5/1992 | Jane et al. | |
| 5,388,739 | A * | 2/1995 | Gargan | 224/604 |
| 5,502,158 | A | 3/1996 | Sinclair et al. | |
| 5,640,742 | A * | 6/1997 | White et al. | 24/3.12 |
| 5,669,119 | A * | 9/1997 | Seron | 24/265 H |
| 6,197,396 | B1 * | 3/2001 | Haas et al. | 428/40.1 |
| 6,235,815 | B1 | 5/2001 | Loercks et al. | |
| 6,711,785 | B1 * | 3/2004 | Hicks et al. | 24/3.4 |
| 6,725,506 | B1 * | 4/2004 | Anscher | 24/3.4 |
| 6,987,138 | B2 | 1/2006 | Tokiwa et al. | |
| 2006/0152368 | A1 * | 7/2006 | Turner et al. | 340/572.1 |
| 2006/0250254 | A1 * | 11/2006 | Harris et al. | 340/572.8 |

* cited by examiner

*Primary Examiner* — Joanne Silbermann
*Assistant Examiner* — Christopher E Veraa
(74) *Attorney, Agent, or Firm* — Paul M. Denk

(57) ABSTRACT

The biodegradable badge has a paper name tag placed within a translucent envelope carried by a lanyard secured to the envelope by at least one clamp. The paper name tag degrades readily. The translucent envelope shows the name tag but upon disposing of the envelope, it degrades in the waste stream and at a landfill. The envelope has a material that degrades rapidly by solar, thermal, and chemical action with minimal release of toxic and volatile organic compounds. The lanyard also degrades readily in the waste stream with material such as textile blends or that of the envelope. The clamp joins the lanyard to the envelope. Designed for single use, the clamp strongly grips the lanyard and then the envelope, and then the clamp degrades when placed in the waste stream. The entire biodegradable badge poses no long-term pollution of the environment as it uses formulations, such as polyethylene terephthalate (g) and poly lactic acid, along with natural fibers such as cotton and wool.

7 Claims, 3 Drawing Sheets

BIODEGRADABLE BADGE

CROSS-REFERENCE TO RELATED APPLICATIONS

This non-provisional patent application claims priority to the provisional patent application having Ser. No. 61/005,292, which was filed on Dec. 4, 2007.

BACKGROUND OF THE INVENTION

This biodegradable badge relates to name badges for meetings and conventions and more specifically to the manufacture and material of a badge envelope and a lanyard with a clip that degrade upon extended exposure to sunlight, oxygen, and moisture.

Promoting goodwill and the exchange of information, meetings and conventions seek conversation and dialogue among their attendees, the people attending the meeting or convention. Conversations occur among two or more people. However, starting a conversation requires skill and a little risk taking. Often, people express reluctance at starting a conversation, especially with a stranger. Larger meetings and conventions generally have many people attending, most of them strangers to one another.

As a means of overcoming shyness and reluctance to start a conversation, event planners and organizers provide name badges to attendees of meetings and conventions. The name badges have the name of an attendee and the meeting or convention title printed on the badge. The name badge can be an adhesive decal that releasably sticks to clothing. The name badge can be a durable tag that releasably pins to clothing. Often, a name badge includes a paper tag with the attendee's name and meeting title printed upon it. The name tag is then inserted into a small envelope with a least one transparent face to reveal the attendee's name. Then the envelope is clasped within a lanyard and the attendee wears the lanyard about his/her neck during the meeting or convention. Attendees report that the sight of others wearing name tags similar to theirs boosts camaraderie and exchange of information during the meeting. The lanyards also provide a print receptive surface for advertisers. The event planners often sell the advertising space upon lanyards to defray meeting costs. Attendees walk around a meeting venue displaying the name of the advertiser on the lanyard. The lanyard often includes a clip for grasping the envelope containing the nametag.

Like other events and good times, meetings and conventions come to an end. After a meeting or convention, attendees return home with many things, such as promotional items, collected at the meeting. Often, the promotional items languish on shelves and tables in offices. In time, the promotional items are given away to others or disposed. Along with the promotional items, the name tags, envelopes, and lanyards enter the waste stream and collect in landfills.

DESCRIPTION OF THE PRIOR ART

Existing envelopes for name tags come from transparent material. Though one transparent surface provides visibility to a name tag, manufacturing efficiencies arise when the entire envelope is transparent. Presently, name tag envelopes are made from polyvinylchloride or polyethylene, one of the polyolefin chemicals. In the common thicknesses for name tag envelopes, polyethylene shows remarkable durability and resistance to degradation when in the waste stream and in landfills. Lanyards generally have a flexible elongated loop with a clip defining one end. The loop is often a blend of cotton or other textile material and occasionally made of plastic synthetic like product, or rayon. Textile lanyards can degrade upon exposure to moisture and the hazards of the waste stream. The clip of a lanyard often includes a two-jaw spring-actuated steel clamp. Though steel rusts and degrades in time, steel remains present in landfills for decades. Presently, the event planning community and attendees of meetings and conventions heavily favor environmentally friendly, or green, products. As most name tags, name badges, envelopes, and lanyards are eventually discarded, materials that degrade in the waste stream prior to reaching a landfill have become fashionable and desirable to consumers, meeting attendees, and event planners.

Over the years, manufacturers and users of plastics have sought formulations that degrade. Polyvinylchloride or polyethylene polyolefins have approached ready degradation as research and experimentation progressed over the years. Research has sought degradation of plastics through catalytic additives of various kinds and some biological mechanisms. Of the polyolefins, polyethylene has shown promise for biological degradation. Polyethylene has a molecular weight in excess of 250,000 grams. These large molecules provide the toughness and flexibility desired by plastic film users. However, such a long molecule lasts for decades when disposed in the environment. Existing microbes and solar radiation have difficulty in breaking down the heavy polyethylene molecule.

The U.S. patent to Jane and colleagues, U.S. Pat. No. 5,115,000, describes plastics with starch and polyethylene that biodegrade. This plastic has up to 50% by weight of starch blending with polyethylene at temperatures over 110° C. While starch attracts water and polyethylene repels water, blending these components has been a challenge. Jane blended oxidized polyethylene which improved the tensile strength of this plastic for a host of uses and then degradation following use. However, this compound has limited translucency.

Other research has found polyethylene terephthalate (g) (PETG) as a biodegradable name tag. PETG provides a rigid opaque plastic suitable for engraving or scribing as done in making name tags for employees and staff. Additionally, PETG has limited release of volatile organic compounds during its degradation in the environment. Further research now pursues the degradation of polyethylene in the presence of oxygen at concentrations found in the environment.

The U.S. patent to Sinclair and Lipinsky, U.S. Pat. No. 5,502,158, describes another degradable polymer. This polymer composition has a polymer that degrades in the presence of water and a modifier that accelerates the degradation. The modifier has non-volatile and non-fugitive characteristics limiting its release into the atmosphere. This polymer composition has application in consumer products of short useful life that appears in large volumes in landfills.

The U.S. patent to Loercks et al., U.S. Pat. No. 6,235,815, provides another polymeric mixture with thermoplastic starch. This mixture has native starch blended with a plasticizing polymer, such as polyester, polyethylene, and the like, and water. The plasticizing polymer further serves as a homogenizing agent that reduces the resulting water content of the mixture to less than 1% by weight.

Different researchers have also sought other degradable formulations such as polylactide (PLA). PLA has high strength and modulus. of elasticity but is relatively brittle. PLA though is a biodegradable polymer that can be formed upon existing polymer processing lines and machinery. Unlike petroleum based polymers, PLA comes from the poly lactic acid derived from corn. Where petroleum takes millennia to accumulate, PLA requires a mere growing season of a crop to accumulate. Production of PLA uses less energy than conventional plastic production methods.

Further, the U.S. patent to Tokiwa and Raku, U.S. Pat. No. 6,987,138, provides a biodegradable polylactide resin. This resin combines polylactide and a naturally produced protein. The protein includes silk, keratin, gluten, and soybean, among others. This resin combines the mechanical and physical properties of polylactide with the biodegradation of proteins. Further, this resin uses a polylactide of less than 1,000,000 gram and preferably less than 100,000 gram molecular weight. This weight is considerably less than polyethylene.

PLA films have now appeared on the marketplace. These films have the names of EVLON® PLA film from Bi-Ax International, Inc., and EarthFirst® PLA film from Plastic Suppliers, Inc.

The present invention overcomes the limitations of the prior art. That is, in the art of the present invention, a biodegradable badge combines a lanyard, a translucent envelope, and a name tag with a single use fastener. The resulting name badge, after hanging from the neck of a meeting attendee, then rapidly degrades in the waste stream when exposed to oxygen, water, and sunlight.

SUMMARY OF THE INVENTION

The preferred embodiment of the biodegradable badge has a paper name tag placed within a translucent envelope carried by a lanyard secured to the envelope by at least one single-use clamp. The paper name tag degrades readily upon exposure to water. The translucent envelope allows for visibility of the name tag placed inside but upon disposal, the envelope degrades under the conditions in the waste stream and at a landfill. The envelope has a material that degrades rapidly by solar, thermal, and chemical action with a minimum of toxic and volatile organic compounds being released. The lanyard also has a material that degrades readily when in the waste stream such as textile blends or the same material as the envelope. The single use clamp joins the lanyard to the envelope and allows the envelope to hang from the neck of a person attending a meeting. Designed for single use, the clamp also has a material that strongly grips the lanyard and then the envelope during usage and degrades when placed in the waste stream.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

Therefore the object of the present invention is to provide a biodegradable badge that breaks down into smaller molecules and inert gases for reintroduction into the environment.

Another object of the biodegradable badge is to allow for viewing of the contents of the badge during usage.

Another object of the biodegradable badge is to provide materials of such composition that has a low cost of manufacturing so the meeting planners and event organizers, on behalf of meeting attendees, can readily purchase the biodegradable badge through existing retail outlets and retailers can source the badge from existing wholesalers and suppliers.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
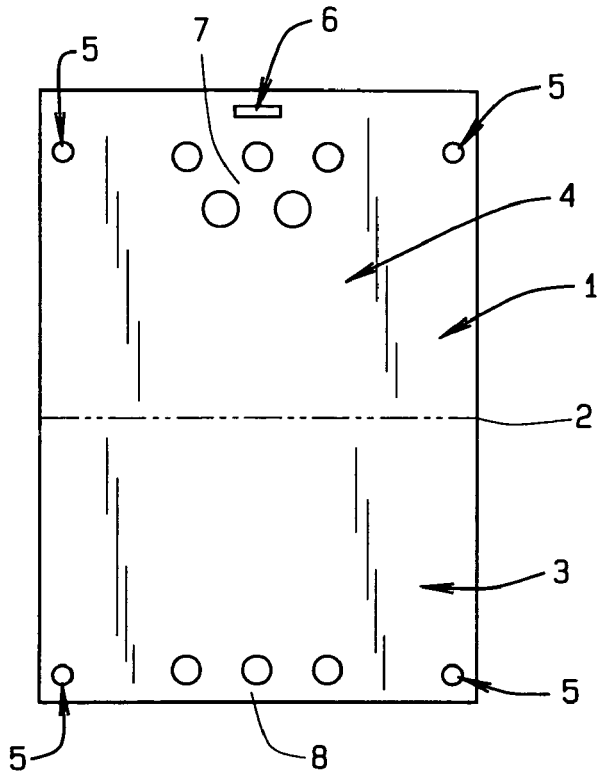
FIG. 1 shows a top view of an envelope in flat form using the biodegradable material of this invention.

The present invention overcomes the prior art limitations by assembling a name badge for those attending meeting and conventions from components that degrade upon exposure to the elements when in the waste stream and at a landfill. Following manufacturing, consumers use a host of plastic goods. After use, consumers generally discard plastic goods which enter the waste stream and a landfill. Ultimately, the plastic goods degrade in a landfill, albeit very slowly, and return to the environment. The present invention degrades following use in a controlled manner promoting responsible ecology and respect for the environment.

The present invention begins as a polyolefin that then degrades in a two step mechanism: first, oxidation spurred on by catalytic additives; and, second, biological degradation by microorganisms. The oxidation initially weakens the polyolefin molecule upon exposure to sunlight, particularly ultraviolet light, to temperatures generally greater than room temperature, and to the chemicals naturally present in water and soils. The oxidation of the present invention occurs in both the anaerobic environment of a landfill with curtailed exposure to oxygen and the aerobic location of a composting operation exposed to oxygen. The oxidation progressively breaks apart the polyolefin molecules of the invention to lighter molecular weights that discolor and fragment to smaller molecules. In time, the remaining molecules of the present invention reach a small size suitable for digestion by micro-organisms resulting in carbon dioxide, water, and biomass that readily return to the environment.

To reach the microorganisms for complete breakdown of the present invention through biodegradation, the polyolefins require reduction to smaller molecules. For example, polyethylene has a molecular weight of 300,000 grams. The present invention degrades the polyethylene molecule so that more molecular ends become present. These exposed ends allow microorganisms to remove small carbon chains from the polyethylene molecule, about two carbon atom fragments. As the microorganisms progress, the molecular weight of the remaining polyethylene decreases thus, making the partially degraded molecule more attractive to additional microorganisms. In time, the microorganisms convert the hydrogen and carbon from the polyethylene molecule into water and carbon dioxide along with the biomass of the microorganisms.

The material of the present invention degrades in less than 120 days and becomes at least 60% mineralized within two years following disposal. Degradation though slows to less than 18 months in the anaerobic environment of a landfill. The components of the present invention and its resulting residues meet FDA requirements and EPA heavy metal limitations. The residues of the present invention do not accumulate to harmful levels in the soil, water table, or the atmosphere. The present invention seeks to mitigate the harmful effects of inert plastics by adjusting the plastic formulation at time of manufacture. The present invention incorporates ingredients and processes that render the plastic suitable for conventional uses and for degrading readily following use. The present invention degrades in a short time while conventional plastics degrade over the centuries. The degradation of the present invention returns carbon atoms from the polyolefins to lesser molecules using microbes in a controlled manner at a known rate. The present invention reduces the problem of plastics accumulating as litter and as waste in a landfill as the plastics degrade to smaller less harmful molecules.

Turning to FIG. 1, the biodegradable badge begins as a sheet 1, generally rectangular in shape, cut from a larger supply of biodegradable material. The sheet has longitudinal axis and a fold line 2 across the sheet. The fold line divides the sheet into an outer section 3 and an inner section 4. The outer section is slightly less in length on the longitudinal axis than the inner section. The variation in length between the sections is later illustrated in FIG. 2. The outer section includes two corners of the sheet and each corner has a corner aperture 5 inward from the edges of the sheet. In line with the corner apertures 5, the outer section has a hole pattern 8 that includes at least two holes though three are shown here. This hole pattern 8 is generally centered upon the outer section proximate the edge of the sheet opposite the fold line 2.

Opposite the outer section 3, the sheet has the inner section 4 upon the contiguous fold line 2. The inner section has the other two corners of the sheet and each corner has a corner aperture 5. Upon the inner section the corner apertures are located further from the edge opposite the fold line 2 than those corner apertures in the outer section. The center of the edge opposite the fold line has an elongated center hole 6 generally proximate that edge. Between the corner apertures 5, the inner section has a hole pattern 7 of at least two holes though this embodiment has five holes arrayed in a trio and a duo. The trio of holes is generally upon the same line as the corner apertures 5 and the duo of holes is centered upon the trio of holes but closer to the fold line 2. The hole pattern 7 of the inner section and the hole pattern 8 of the outer section have holes with a diameter exceeding the diameter of the corner apertures 5.

Figure 2:
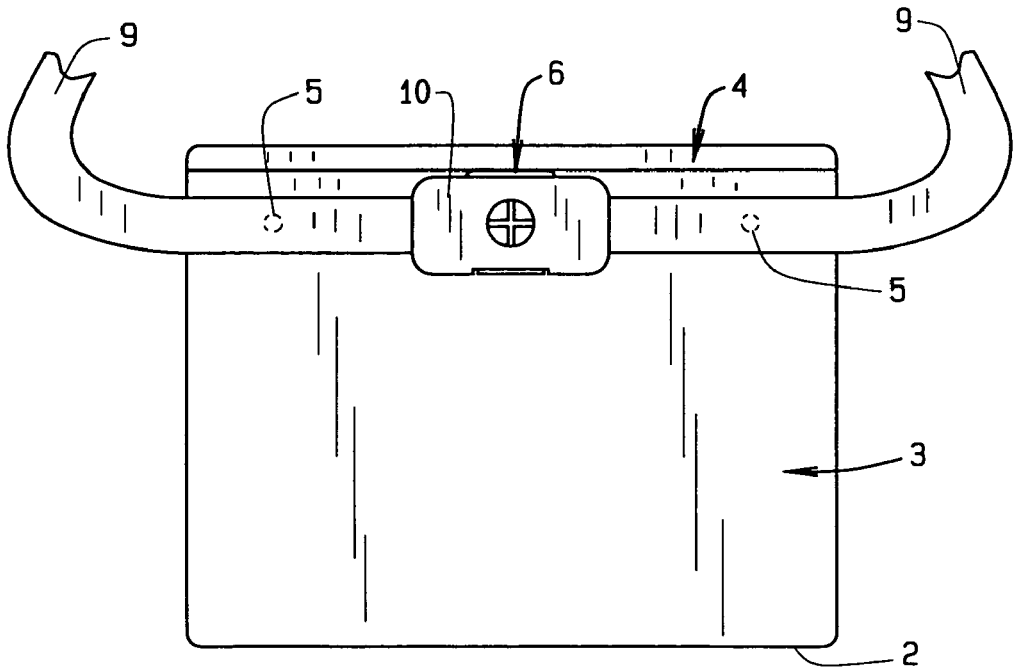
FIG. 2 shows a front view of an envelope with a lanyard secured by the clamp at one location.

For usage at a meeting, conference, or convention, the sheet 1 is closed upon the fold line 2 with the outer section 3 folding upon the inner section 4 resulting in the center hole 6 locating upwardly as in FIG. 2. The folded sheet becomes an envelope for containing a paper badge printed with the name of an attendee. The envelope has a sealed bottom edge at the fold line 2 and then the remaining two edges are sealed using existing polymer joining machinery and processes. Such sealing includes thermal, sonic, and chemical welding, and mechanical stitching. The envelope here shown has the outer section 3 in the foreground with the inner section 4 behind. The off center location of the fold line 2 upon the sheet 1 guides the outer section to fold upon the inner section leaving a strip of inner section visible and the edge of the outer section accessible for opening of the envelope. An event organizer or an attendee can then insert a paper name badge into the envelope. The inner section has the center hole 6 generally upwardly in this figure as during usage. Proximate the center hole, the present invention has a clamp 10 extending through the holes at the center of the hole patterns 7, 8. The clamp grips the ends of a lanyard 9 and inserts into the envelope that does not allow removal of the clamp from the envelope for reuse. Secured by one clamp, the lanyard extends away from the envelope for an attendee to place about his neck. The envelope then balances about the clamp to attain a level orientation.

Figure 3:
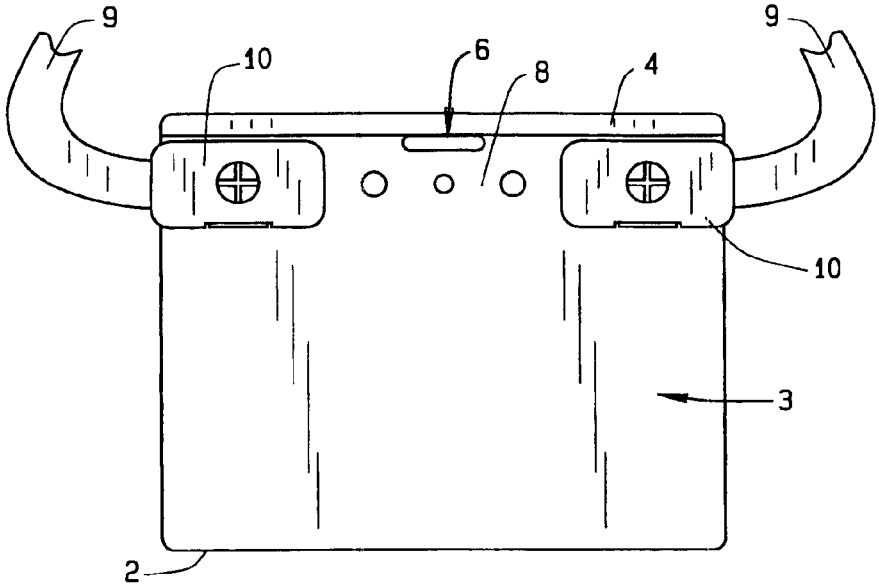
FIG. 3 describes a front view of an envelope with a lanyard secured at two locations by clamps.

However, envelopes sometimes become askew as ribbons, pins, buttons, and other items accumulate over the course of a convention. FIG. 3 shows an envelope secured to a lanyard by a clamp at both ends of the lanyard. As before, the envelope is the sheet folded upon the fold line 2 so that the outer section 3 abuts the inner section 4 and both sections are sealed upon three common perimeter edges. In this embodiment, each end of a lanyard 9 has a clamp 10 for securing the lanyard to the envelope. Each clamp then connects to the aligned corner apertures 5 of the inner section and the outer section. In this embodiment, the center hole 6 and the hole pattern 8 are visible to an attendee. With the envelope secured at two points, the envelope remains level as it accumulates items pinned to it off center.

Figure 4:
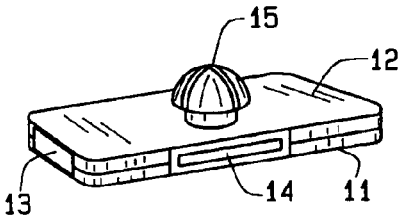
FIG. 4 illustrates a closed clamp of this invention.
Figure 5:
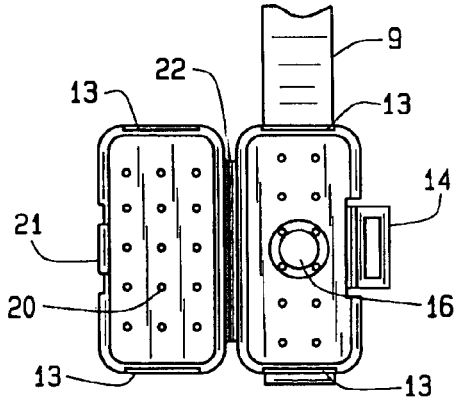
FIG. 5 describes the connection of the lanyard to the clamp.

The clamps of the present invention are shown in FIGS. 4 thru 5. FIG. 4 shows a clamp 10 without a lanyard. The clamp, made of similar material to the sheet, degrades in the environment much faster than the steel two jaw clamps currently used. The clamp has an inner half 11 hingedly connected to an outer half 12 upon a common longitudinal edge. Opposite the hinged connection, the clamp has a ring 14 that secures the inner half and the outer half in a closed position. Upon the common lateral edges of the inner half and the outer half, the clamp has two slots 13 that admit an end of a lanyard for securement therein. Now the inner half has a pin 15 generally centered thereon. The pin enters the corner aperture 5 for connecting the clamp to an envelope.

Figure 4A:
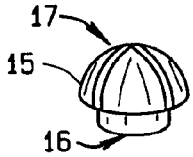
FIG. 4*a* shows a detailed view of the pin of the closed clamp.

The pin is shown in more detail in FIG. 4*a*. The pin has a base 16, generally round that joins to the inner half. Above the base, a split dome 17 has a radius greater than the radius of the base but only slightly greater than the radius of a corner aperture. The dome has at least two splits extending through the depth of the dome thus dividing the dome into chords. Under pressure, the chords compress together without detaching from the base. The compressed chords then pass through the corner aperture and then return to the normal shape of the dome. The envelope then hangs upon the base 16.

Figure 4B:
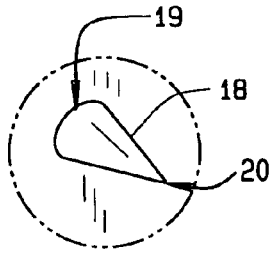
FIG. 4*b* shows a detailed view of a tooth of the clamp.
Figure 4C:
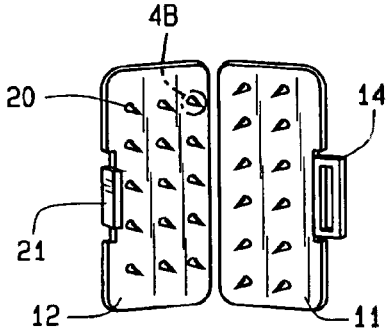
FIG. 4*c* illustrates the open interior of the clamp of this invention.

Within the clamp, the outer half and the inner half each have a plurality of mechanical means like teeth 20, as at FIG. 4*c*, for gripping the lanyard. In the preferred embodiment each tooth, as at FIG. 4*b*, has a generally conic shape with a wide round base 19 integrated with the upper half or the inner half, a conical surface 18, and an opposite apex that inserts into the end of a lanyard. The lanyard generally has a woven fabric material or a penetrable plastic of lesser hardness than a tooth 20.

FIG. 4*c* shows the inside faces of the inner half and the outer half having a plurality of teeth 18 thereon. The inner half 11 connects to the outer half 12 upon a common longitudinal edge. Opposite the common edge, the inner half has a ring 14 here shown as rectangular though other shapes are foreseen. The ring extends outwardly from the inner half but pivots at its joint with the inner half. The outer half has a key 21 opposite the common edge. The key is integral with the perimeter edge of the outer half and aligned with the ring so that upon closing of the clamp, the key inserts within the ring to retain the clamp as closed during usage as shown in FIG. 4 previously.

In usage, a lanyard 9 approaches the clamp as shown in FIG. 5. The lanyard has an end inserted in a slot 13 here upon one end of the inner half. The lanyard then rests upon the teeth 20, ready for the outer half 12 to close upon the inner half 11. The outer half and the inner half join upon a common hinge 22 along a longitudinal edge. In this embodiment, the inner half and the outer half have rounded corners of a generally rectangular shape. Outwardly from the hinge 22, the inner half has the ring 14 prepared to engage the key 21. The outer half and the inner half each have matching slots 13 upon the lateral ends for receiving the ends of one or two lanyards as needed. Upon the inside faces, the outer half and the inner half also have fields of teeth 20 for gripping the lanyard ends firmly when the clamp is closed. The closed clamp then connects with an envelope and makes the biodegradable badge ready for use.

Figure 6B:
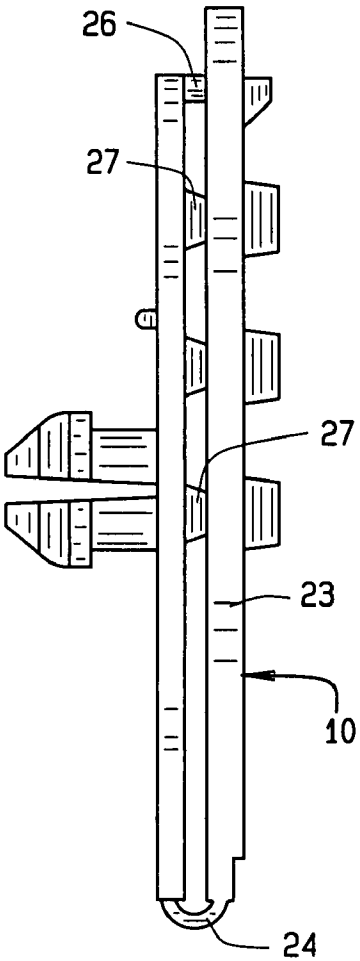
FIG. 6*b* shows a side view of the clamp means.
Figure 6A:
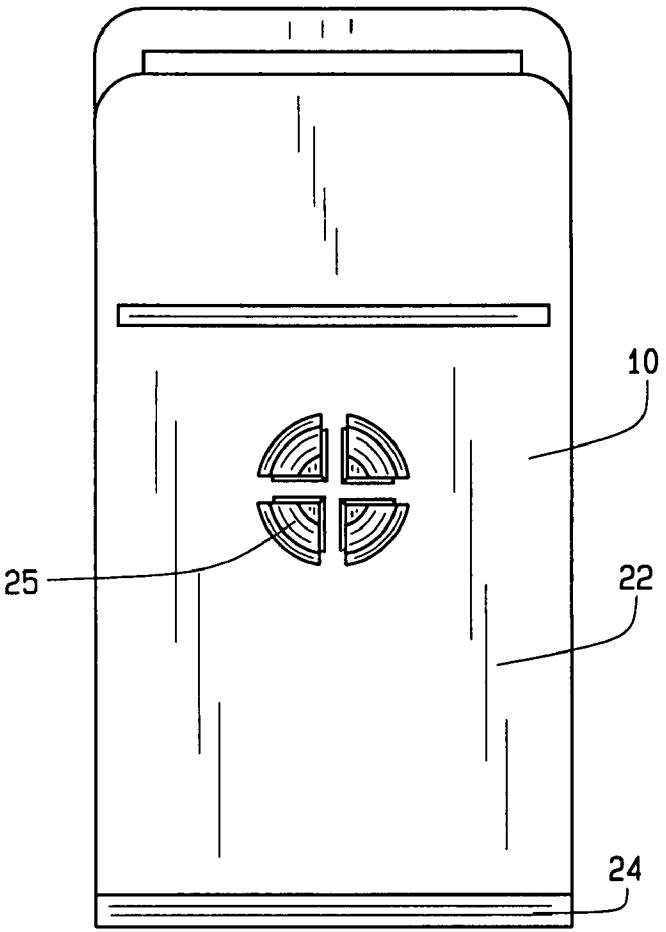
FIG. 6*a* shows a front view of the clamp means.

FIGS. 6*a* and 6*b* show the clamp means 10 of this invention. It is somewhat revised from that as previously described in FIG. 4 of this description. Essentially, it includes an outer half 22, and an inner half 23, each held together for pivotal movement by means of the living hinge 24. A similar type pin 25 is provided upon the inner half 22, and has the various slots, as previously described, in this instance at 26, for entrance of the lanyard. The various protrusion, as at 27, are provided for gripping of the end of the lanyard that enters into the clap means.

From the aforementioned description, a biodegradable badge has been described. The system is uniquely capable of its sheet, envelope, lanyard, and clamp degrading in the environment to lesser compounds in less than 18 months. The badge and its components may be manufactured from many materials, including but not limited to, wool, cotton, paper, denim, poplin, sisal, bark, polyethylene terephthalate (g), poly lactic acid, polyethylene terephthalate (g) with starch, poly lactic acid with starch, or poly lactic acid with resin, and other plant derivatives, polymers, and composites.

I claim:

1. A device to display the name of a person temporarily about the body of the person, comprising:

an envelope, generally transparent and planar, having at least one edge upon the perimeter, being open upon one edge, and degrading in the environment;

a lanyard, generally elongated and flexible, having two ends, supporting said envelope upon said person, and degrading in the environment; and, at least one clamp, securing said lanyard to said envelope upon at least one position, and degrading in the environment, and said clamp having an outer half hingedly connecting to an inner half upon a common edge, said outer half having a mechanical means therein for grasping an end of a lanyard, at least one slot perpendicular to said hinged connection and a securing means opposite said hinged connection, said inner half having a mechanical means therein for grasping an end of a lanyard, at least one slot perpendicular to said hinged connection, a securing means opposite said hinged connection, and a single use fastener opposite said mechanical means, said single use fastener comprising a pin perpendicular to said outer half, said pin having a base upon said outer half and a dome upon said base, said dome having a radius greater than half of the width of said base and at least two splits dividing said dome into chords, said dome inserting into said envelope for securing said clamp to said envelope.

2. The name display device of claim 1 wherein said envelope and said at least one clamp are made of one of polyethylene terephthalate (g), polylactic.acid, polyethylene terephthalate (g) with starch, poly lactic acid with starch, or poly lactic acid with resin.

3. The name display device of claim 1 wherein said lanyard is made of one of wool, cotton, paper, denim, poplin, sisal, bark, polyethylene terephthalate (g), poly lactic acid, polyethylene terephthalate (g) with starch, poly lactic acid with starch or poly lactic acid with resin.

4. The name display device of claim 1 further comprising:

said envelope having an outer section and an opposite inner section joining upon a fold line and sealing upon the remaining edges of said envelope, said inner section having a greater height than said outer section, said inner section and said outer section each having at least one aperture aligning for insertion of said clamp therethrough.

5. The name display device of claim 4 wherein said envelope has a rectangular shape.

6. The name display device of claim 1 further comprising: said securing means including a key upon said outer half and a ring upon said inner half wherein said key fits within said ring.

7. The name display device of claim 1 including two clamps.

* * * * *